US009326649B1

(12) United States Patent
Ophori

(10) Patent No.: US 9,326,649 B1
(45) Date of Patent: May 3, 2016

(54) TOILET SEAT LIFTER-TOILET FOOT PEDAL SYSTEMS

(71) Applicant: Duke Ophori, Bloomfield, NJ (US)

(72) Inventor: Duke Ophori, Bloomfield, NJ (US)

( * ) Notice: Subject to any disclaimer, the term of this patent is extended or adjusted under 35 U.S.C. 154(b) by 0 days.

(21) Appl. No.: 14/530,734

(22) Filed: Nov. 1, 2014

Related U.S. Application Data

(60) Provisional application No. 61/899,271, filed on Nov. 3, 2013.

(51) Int. Cl.
*A47K 13/00* (2006.01)
*A47K 13/10* (2006.01)

(52) U.S. Cl.
CPC ..... *A47K 13/10* (2013.01)

(58) Field of Classification Search
CPC ..... A47K 13/10
USPC ..... 4/246.1–246.5
See application file for complete search history.

(56) References Cited

U.S. PATENT DOCUMENTS 5,327,589 A * 7/1994 Rice ..... A47K 13/10 4/246.2
6,907,621 B2 * 6/2005 Stemen ..... A47K 13/10 4/243.1
7,003,815 B2 * 2/2006 Herbst ..... E03D 5/08 4/246.1
7,334,271 B2 * 2/2008 Jung ..... A47K 13/10 4/246.1
8,082,604 B2 * 12/2011 Isaac ..... A47K 13/10 4/246.2
2008/0066221 A1 * 3/2008 Pantos ..... A47K 13/105 4/246.4
2008/0127404 A1 * 6/2008 Kruger ..... A47K 13/10 4/246.2
2008/0178374 A1 * 7/2008 Abrams ..... A47K 13/10 4/246.2
2010/0005580 A1 * 1/2010 Borochov ..... A47K 13/10 4/246.2
2013/0007952 A1 * 1/2013 Gomez-Espana Collignon ..... A47K 13/10 4/246.2
2013/0160196 A1 * 6/2013 Gomez Espana Collignon ..... A47K 13/10 4/246.2
2013/0340155 A1 * 12/2013 Gomez Espana Collignon ..... A47K 13/10 4/246.2
2015/0250365 A1 * 9/2015 Gomez Espana Collignon ..... F16H 35/18 4/246.2

* cited by examiner

*Primary Examiner* — Lori Baker
(74) *Attorney, Agent, or Firm* — RG Patent Consulting, LLC; Rachel Gilboy

(57) ABSTRACT

A specially designed toilet seat accessory that is operated via hydraulics and an integrated, electronic foot pedal to provide consumers a sanitary and convenient hands-free method of lifting and lowering the toilet seat.

12 Claims, 5 Drawing Sheets

TOILET SEAT LIFTER-TOILET FOOT PEDAL SYSTEMS

CROSS-REFERENCE TO RELATED APPLICATION

The present application is related to and claims priority from prior provisional application Ser. No. 61/899,271, filed Nov. 3, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of lifting devices for toilet seats and more specifically relates to a specially designed toilet seat accessory of a toilet seat lifter-toilet foot pedal system that is operatable to provide consumers with a sanitary and convenient hands-free means for lifting and lowering a toilet seat and toilet seat cover.

DESCRIPTION OF THE RELATED ART

Many modern households and commercial buildings have at least one bathroom. The bathroom is the one room in the home where people shower or bathe, brush their teeth, shave, apply make-up and undergo other personal grooming tasks. Perhaps most importantly, the bathroom houses that most necessary of items; the toilet. The need to use the toilet is something every human being shares in common. While toilets are an important necessity, many consumers who live in households with male children, teens, or adults find that this most useful amenity has several drawbacks. Specifically, men and boys alike can typically forget or simply not bother to put the toilet seat down after using the facilities.

As humorous as it may seem, many consumers have experienced the scenario of sitting on the toilet, only to fall into the bowl because the seat had been left up. In addition, most consumers simply dread the thought of lifting or lowering a toilet seat. Coming into direct contact with a toilet seat is not only repulsive, it is actually extremely unsanitary. Considering the quantity of germs and bacteria that may be lurking, it is no wonder many do not bother to reposition the seat, especially in public restrooms. It is desirable in the interest of public health that a sanitary means for operating toilet lids between open and closed conditions be forth-coming.

Various attempts have been made to solve the above-mentioned problems such as those found in U.S. Pub. No. 2008/0066221 to William P. Pantos et al, U.S. Pat. No. 5,327,589 to Ori Pelled et al, U.S. Pub. No. 2008/0127404 to Johannes Gideon Francois Kruger et al, and U.S. Pat. No. 7,334,271 to Man-Young Jung. This art is representative of lifting devices for toilet seats. None of the above inventions and patents, taken either singly or in combination, is seen to describe the invention as claimed.

Ideally, a toilet seat lifter-toilet foot pedal system should provide hands-free and sanitary use of equipped toilet fixtures and, yet would operate reliably and be manufactured at a modest expense. Thus, a need exists for a reliable toilet seat lifter-toilet foot pedal system to avoid the above-mentioned problems.

BRIEF SUMMARY OF THE INVENTION

In view of the foregoing disadvantages inherent in the known toilet accessory art, the present invention provides a novel toilet seat lifter-toilet foot pedal system. The general purpose of the present invention, which will be described subsequently in greater detail is to provide a sanitary hands-free means for operating so-equipped toilet fixtures.

A toilet seat lifter-toilet foot pedal system is disclosed herein, in a preferred embodiment, comprising a toilet seat lifter-toilet foot pedal assembly including a foot-pedal-assembly having a housing, a first-foot-pad for remotely manipulating a toilet-seat-cover having a first-foot-pedal-valve, a second-foot-pad for remotely manipulating a toilet seat having a second-foot-pedal-valve, a lifting and lowering inducing means (various embodiments are disclosed herein), a connector hose, and a lid engager; the toilet seat lifter-toilet foot pedal system as such comprises the toilet seat lifter-toilet foot pedal assembly.

The toilet seat lifter-toilet foot pedal assembly comprises in functional combination the foot-pedal-assembly, the connector hose, and the lid engager. The foot-pedal-assembly preferably comprises the housing, the first-foot-pad, the second-foot-pad, and the lifting and lowering inducing means suitably in communication for operative use. The connector hose connects the foot-pedal-assembly and the lid engager; the lid engager coupled to the toilet seat and the toilet-seat-cover on a toilet fixture. Upon activation of the first-foot-pedal-valve and the second-foot-pedal-valve a user is able to cycle the toilet-seat-cover and the toilet seat, respectively, between lifted and lowered positions, via the lifting and lowering inducing means.

The lifting and lowering inducing means in preferred embodiments comprises a hydraulic lifter device comprising a cylinder assembly having a piston within a cylinder remotely connected via the connector hose to the lid engager as coupled to the toilet seat and the toilet-seat-cover for raising the toilet seat and the toilet-seat-cover as desired. The foot-pedal-assembly may further comprise at least one compound valve for controlling a supply of fluid (under pressure) to the cylinder, means for connecting a source of hydraulic pressure to the first-foot-pedal-valve and the second-foot-pedal-valve, a compound valve element in the first-foot-pedal-valve and the second-foot-pedal-valve movable in one direction at a time, and means for controlling the supply of hydraulic pressure to and from the cylinder.

The fluid comprises a non-compressible liquid (water, oil or the like). The lid engager may comprise a mechanical gear cluster suitable to manipulate the toilet seat and the toilet-seat-cover about a common axis of rotation (other suitably equivalent manipulation means may be used). The lid engager may further comprise clutches to allow engagement and release of the toilet seat and the toilet-seat-cover according to a number of relative foot-presses for raising and lowering, respectively. As developed, the toilet seat lifter-toilet foot pedal system is structured and arranged to provide sanitary, hands-free manipulation of the toilet seat and the toilet-seat-cover in relation to the toilet fixture to promote improved public health.

A kit is also described herein including: the foot-pedal-assembly, the connector hose, the lid engager, and a set of user-instructions.

A method of using a toilet seat lifter-toilet foot pedal system is also disclosed herein comprising the steps of: installing a toilet seat lifter-toilet foot pedal assembly to a toilet fixture, activating the toilet seat lifter-toilet foot pedal assembly to raise a toilet-seat-cover via a first single foot-push on a first-foot-pad, activating the toilet seat lifter-toilet foot pedal assembly to raise a toilet seat via a single foot-push on a second-foot-pad, and using the toilet fixture. The method may further comprise the steps of activating the toilet seat lifter-toilet foot pedal assembly to lower the toilet seat via a first double foot-push on the second-foot-pad, and activating the toilet seat lifter-toilet foot pedal assembly to lower the toilet-seat-cover via a double foot-push on the first-foot-pad.

The present invention holds significant improvements and serves as a toilet seat lifter-toilet foot pedal system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, toilet seat lifter-toilet foot pedal system, constructed and operative according to the teachings of the present invention.

The various embodiments of the present invention will hereinafter be described in conjunction with the appended drawings, wherein like designations denote like elements.

DETAILED DESCRIPTION

Figure 1:
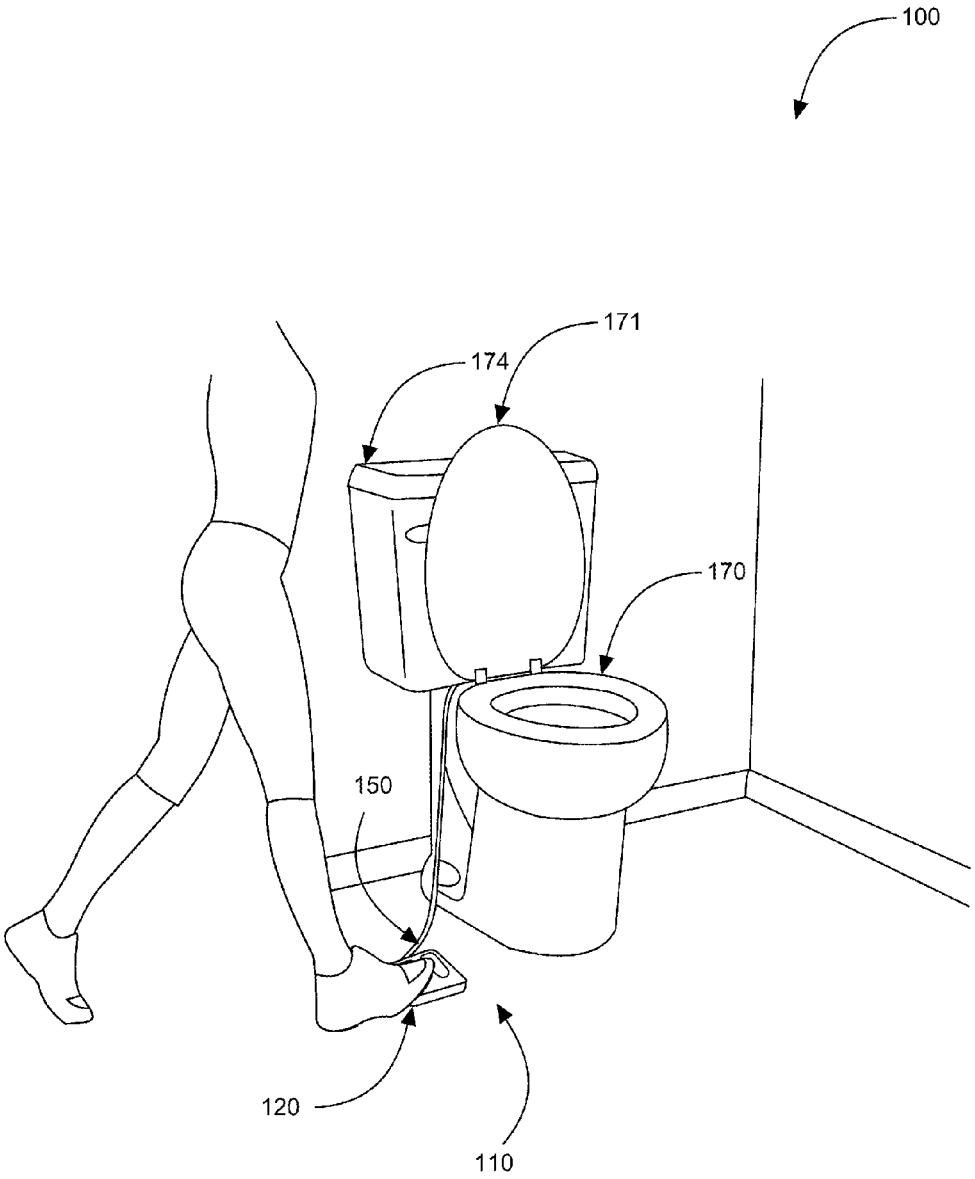
FIG. 1 shows a perspective view illustrating a toilet seat lifter-toilet foot pedal system in an in-use condition according to an embodiment of the present invention.
Figure 2:
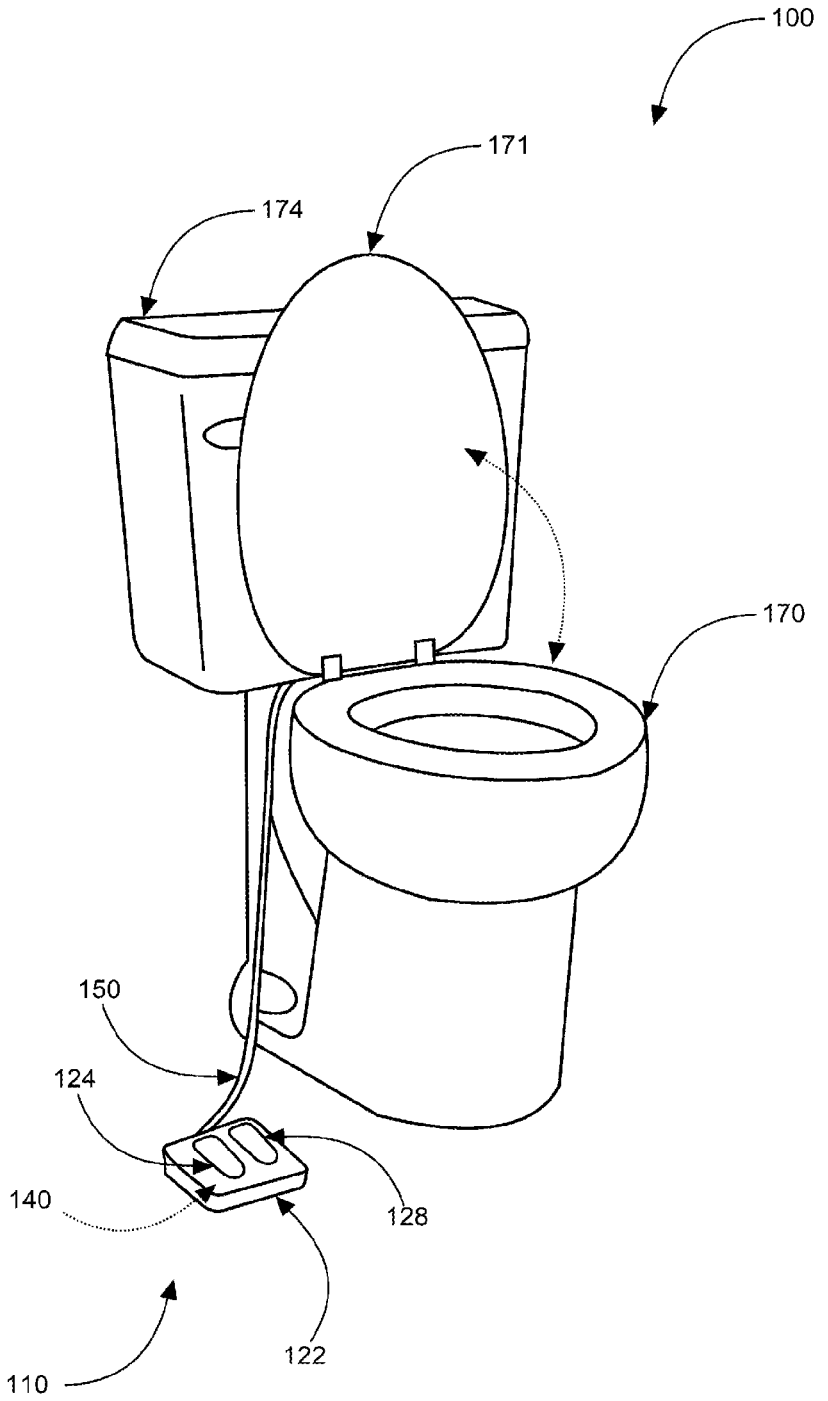
FIG. 2 is a perspective view illustrating a toilet seat lifter-toilet foot pedal assembly of the toilet seat lifter-toilet foot pedal system according to an embodiment of the present invention of FIG. 1.
Figure 3:
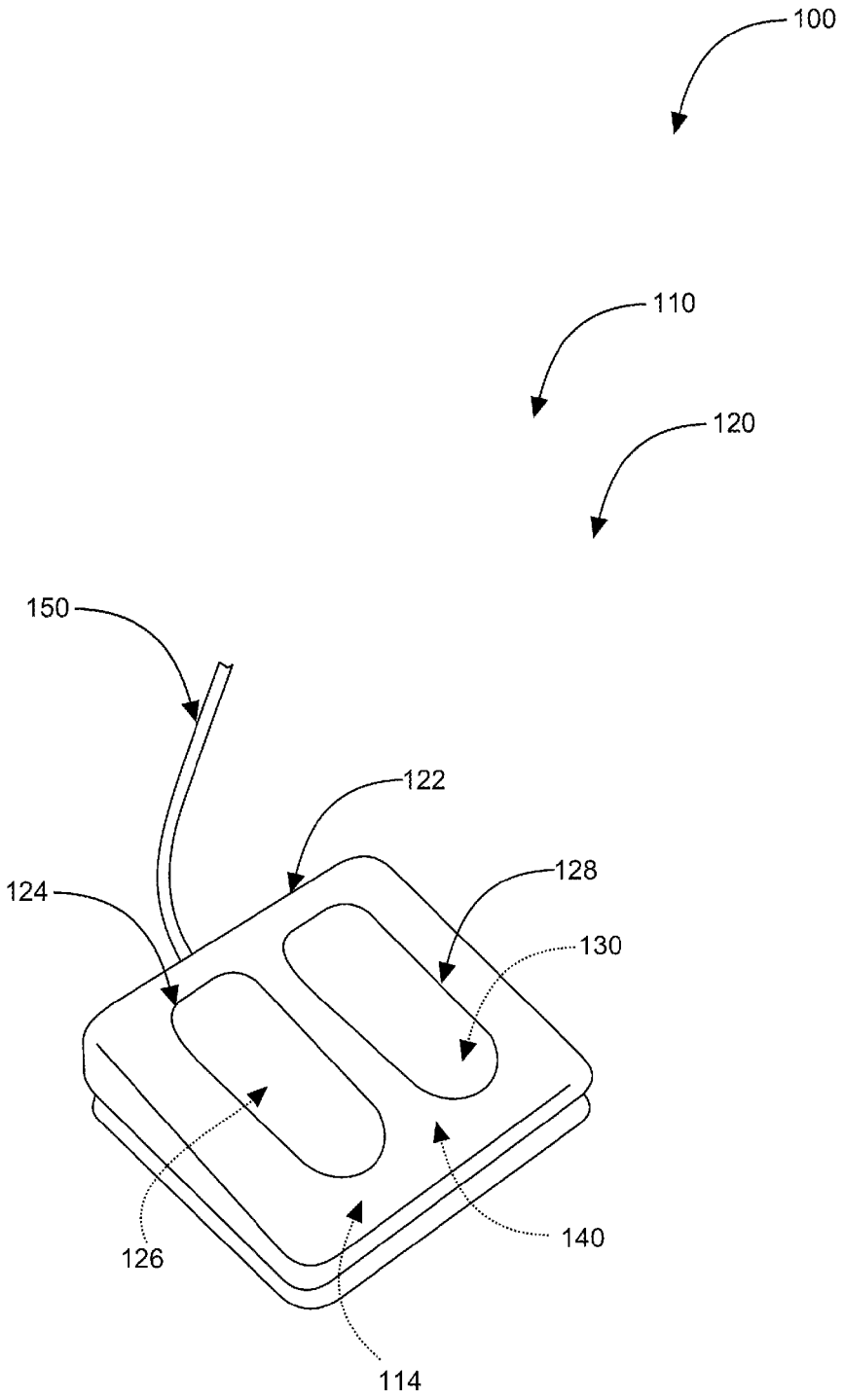
FIG. 3 is a perspective view illustrating a foot pedal assembly of the toilet seat lifter-toilet foot pedal assembly according to an embodiment of the present invention of FIG. 1.
Figure 4:
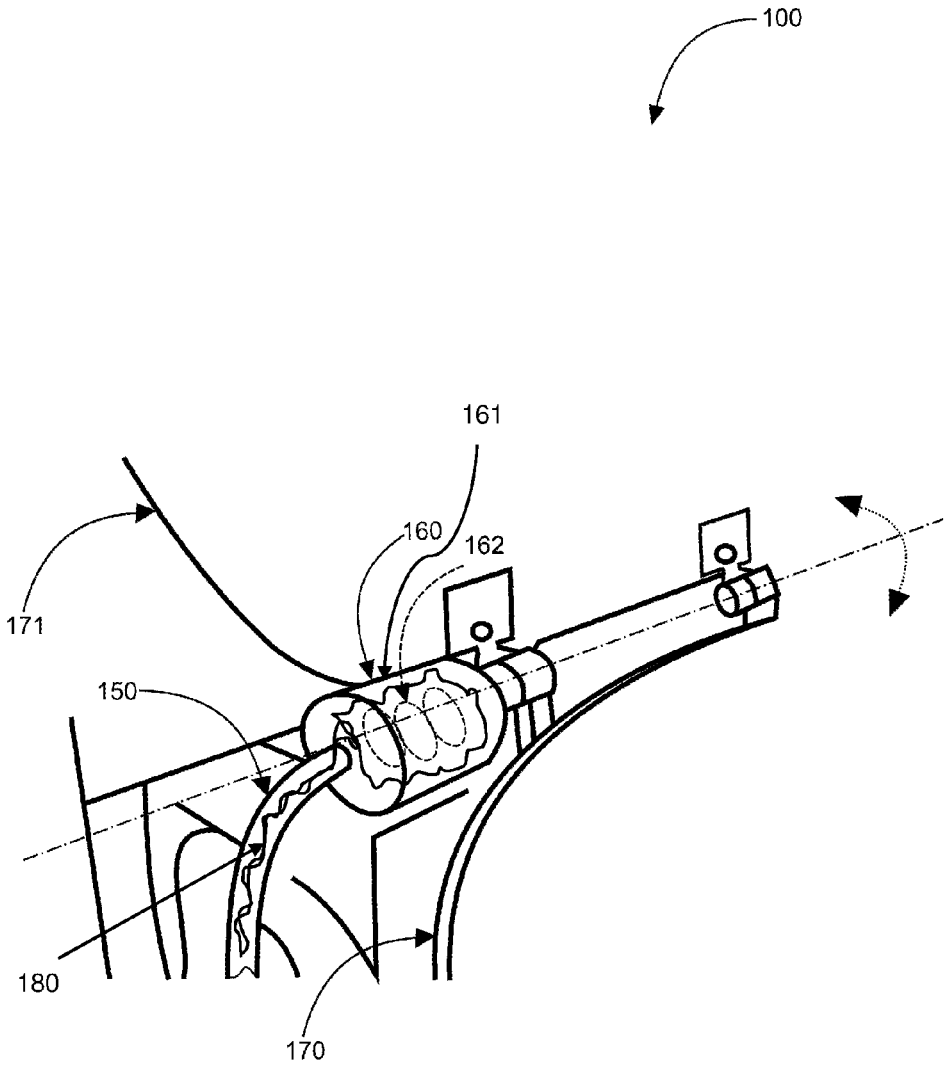
FIG. 4 is a perspective view illustrating a lid engager of the toilet seat lifter-toilet foot pedal system according to an embodiment of the present invention of FIG. 1.

As discussed above, embodiments of the present invention relate to a lid lifting means and more particularly to a toilet seat lifter-toilet foot pedal system as used to improve the public sanitary use of toilets. Generally speaking, the toilet seat lifter-toilet foot pedal comprises a specially designed electronic foot pedal integrally connected to toilet seat assembly which, when depressed, lifts the seat from the toilet bowl and sets it back down after use.

Essentially, a series of hydraulically operated components and appropriate wiring may be integrally connected to both the seat cover and the toilet seat itself. This system may be activated via a rechargeable, battery operated pedal in the form of a pair of buttons located on a rectangular base, located on the floor just beside the base of the toilet bowl. Measuring approximately eight inches by four inches (8"×4"), this control unit may offer two (2) buttons appropriately sized for the foot. The first button (designated Button #1) may control the seat cover, while the second (Button #2) may operate the seat.

Once installed, the Toilet Seat Lifter may be easily activated by any child, teen, or adult user. To lift the toilet seat, the user may simply stand facing the toilet bowl and depress the specially designed foot pedal (or Button #1) one time, with either the right or left foot. With this action, the integrated lever and pivoting connectors may move the cover up off the toilet seat. Next, Button #2 may be depressed with the foot, and the seat may be automatically lifted. After use, the user need only depress the Button #2 pedal again, and then immediately press Button #1, causing the toilet seat, followed by the cover, to gently fall back in place on top of the bowl. The Toilet Seat Lifter may provide a simple yet unique means of lifting and lowering the toilet seat in a hands-free manner. Consumers should appreciate that simply by depressing the conveniently placed foot pedals, they may easily lift the cover and seat up off the toilet, replacing them in a similar fashion after use. Additionally, the practical placement of the foot pedals may provide a visual reminder to those men and boys who typically do not lift the toilet seat to do so.

Keeping toilet seats clean and dry, the toilet seat lifter is a useful product which should be appreciated by all members of the household. Moreover, the toilet seat lifter may offer a hygienic alternative to lifting the toilet seat by hand. This sanitary tool may protect the user from coming into direct contact with the germs and bacteria that are often found on the underside of the toilet seat. This advantage should prove especially beneficial during routine cleaning of the toilet bowl.

With only the pressing of the foot to set the process in motion, this product may also aid those with limited physical capabilities when lifting or lowering the toilet seat. Although developed with the home user in mind, the toilet seat lifter may prove an extremely useful and welcome addition to any public or institutional restroom facility.

Referring to the drawings by numerals of reference there is shown in FIGS. 1-4, various views of toilet seat lifter-toilet foot pedal assembly 110 of toilet seat lifter-toilet foot pedal system 100.

Toilet seat lifter-toilet foot pedal system 100 comprises: toilet seat lifter-toilet foot pedal assembly 110 including foot-pedal-assembly 120 having housing 122 first-foot-pad 124 for remotely manipulating toilet-seat-cover 171 having first-foot-pedal-valve 126 second-foot-pad 128 for remotely manipulating toilet seat 170 having second-foot-pedal-valve 130, lifting and lowering inducing means 140, connector hose 150, and a lid engager 160. Toilet seat lifter-toilet foot pedal system 100 comprises toilet seat lifter-toilet foot pedal assembly 110; toilet seat lifter-toilet foot pedal assembly 110 comprises in functional combination foot-pedal-assembly 120 connector hose 150 (or suitable sheathing depending on the particular embodiment) and lid engager 160. Foot-pedal-assembly 120 comprises housing 122, first-foot-pad 124, second-foot-pad 128 and lifting and lowering inducing means 140 suitably in communication for operative use. Connector hose 150 is designed to connect foot-pedal-assembly 120 and lid engager 160; lid engager 160 coupled to toilet seat 170 and toilet-seat-cover 171 on toilet fixture 174, wherein toilet seat 170 and toilet-seat-cover 171 rotate on a shared axis of rotation.

Upon activation of first-foot-pedal-valve 126 and second-foot-pedal-valve 130 a user is able to cycle toilet-seat-cover 171 and toilet seat 170 respectively, between lifted and lowered positions, via the lifting and lowering inducing means 140. Toilet seat lifter-toilet foot pedal system 110 is structured and arranged to provide sanitary, hands-free manipulation of toilet seat 170 and toilet-seat-cover 171 in relation to toilet fixture 174 to promote improved public health. Lifting and lowering inducing means 140 of toilet seat lifter-toilet foot pedal system 110 may comprise a hydraulic lifter device comprising foot switch 114 and a cylinder 161 remotely connected via connector hose 150 to lid engager 160 as coupled to toilet seat 170 and toilet-seat-cover 171 for raising toilet seat 170 and toilet-seat-cover 171 repeatedly as desired.

Fluid as discussed herein may comprise air, water, or a non-compressible liquid. Those with ordinary skill in the art will now appreciate that upon reading this specification and by their understanding the art of Bernoulli's principle as described herein, methods of use of non-compressible fluids will be understood by those knowledgeable in such art.

Lid engager 160 may comprise mechanical gear cluster 162 (or other suitably equivalent manipulation means—mechanical or non-mechanical) suitable to manipulate toilet seat 170 and toilet-seat-cover 171. Lid engager 160 may further comprise clutches to allow engagement and release of toilet seat 170 and toilet-seat-cover 171 for raising and lowering, respectively. The raising and the lowering by use of toilet seat lifter-toilet foot pedal system 110 is preferably speed-controlled. Foot-pedal-assembly 120 may further comprise at least one compound valve for controlling a supply of fluid under pressure to the cylinder, means for connecting a source of hydraulic pressure to first-foot-pedal-valve 126 and second-foot-pedal-valve 130; a compound valve element in first-foot-pedal-valve 126 and second-foot-pedal-valve 130 movable in one direction at a time, and means for controlling the supply of hydraulic pressure to and from the cylinder.

Lifting and lowering inducing means 140 of toilet seat lifter-toilet foot pedal system 110 may alternately comprise an electrical lifter device; wherein the electrical lifter device is powered by a powerer; the powerer may comprise DC batteries or other suitable powering means. First-foot-pad 124 may be activated to cause a raising condition via a single-press and first-foot-pad 124 may be activated to cause a lowering condition via a double-press in certain embodiments. In a similar manner second-foot-pad 128 may be activated to cause a raising condition via a single-press and second-foot-pad 128 may be activated to cause a lowering condition via a double-press (single press versions may also be used). Hydraulics is preferably used for the present invention described herein for the generation, control, and transmission of power by the use of pressurized fluids 180 that may include air (pneumatic), oil, water, and other such fluids that can be anticipated by Bernoulli's principle. Other means of control may comprise electrical and other suitable equivalent as also described herein.

Toilet seat lifter-toilet foot pedal system 100 may be sold as a kit comprising the following parts: foot-pedal-assembly 120, connector hose 150, lid engager 160, and a set of user-instructions. The kit has instructions such that functional relationships are detailed in relation to the structure of the invention (such that the invention can be used, maintained, or the like in a preferred manner). Toilet seat lifter-toilet foot pedal system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different fluid combinations, parts may be sold separately, etc., may be sufficient.

Figure 5:
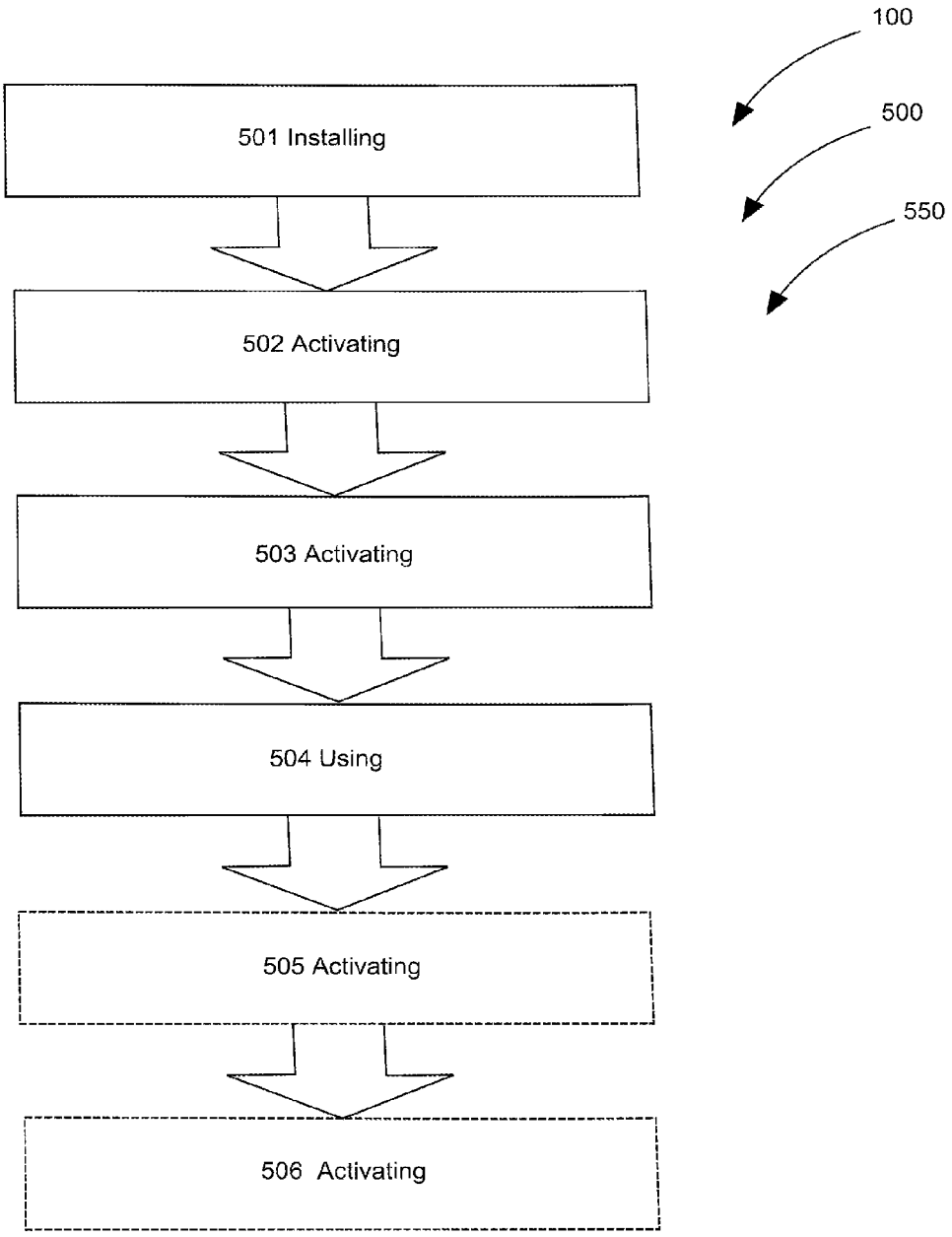
FIG. 5 is a flowchart illustrating a method of use for the toilet seat lifter-toilet foot pedal system according to an embodiment of the present invention of FIGS. 1-4.

Referring now to FIG. 5, a flowchart 550 illustrating a method of use 500 for toilet seat lifter-toilet foot pedal system 100 according to an embodiment of the present invention of FIGS. 1-4.

A method of using (method of use 500) toilet seat lifter-toilet foot pedal system 100 may comprise the steps of: step one 501 installing toilet seat lifter-toilet foot pedal assembly 100 to toilet fixture 174, step two 502 activating toilet seat lifter-toilet foot pedal assembly 110 to raise toilet-seat-cover 171 via a first single foot-push on first-foot-pad 124, step three 503 activating toilet seat lifter-toilet foot pedal assembly 110 to raise toilet seat 170 via a single foot-push on second-foot-pad 128, and step four 504 using toilet fixture 174.

Method of use 500 may further comprise the steps of: step five 505 activating toilet seat lifter-toilet foot pedal assembly 110 to lower toilet seat 170 via a first double foot-push on second-foot-pad 128, and step six 506 activating toilet seat lifter-toilet foot pedal assembly 110 to lower toilet-seat-cover 171 via a double foot-push on first-foot-pad 124.

It should be noted that steps 505-506 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A toilet seat lifter-toilet foot pedal system comprising:

a toilet seat lifter-toilet foot pedal assembly including;

a foot-pedal-assembly having;

a housing;

a first-foot-pad for remotely manipulating a toilet-seat-cover having;

a first-foot-pedal-valve;

a second-foot-pad for remotely manipulating a toilet seat having;

a second-foot-pedal-valve;

a lifting and lowering mechanism;

a connector hose; and a lid engager;

wherein said toilet seat lifter-toilet foot pedal system comprises said toilet seat lifter-toilet foot pedal assembly;

wherein said toilet seat lifter-toilet foot pedal assembly comprises in functional combination said foot-pedal-assembly, said connector hose, and said lid engager;

wherein said foot-pedal-assembly comprises said housing, said first-foot-pad, said second-foot-pad, and said lifting and lowering mechanism are adapted to be in communication for operative use;

wherein said connector hose connects said foot-pedal-assembly and said lid engager, said lid engager coupled to said toilet seat and said toilet-seat-cover on a toilet fixture;

wherein said toilet seat and said toilet-seat-cover rotate on a shared axis of rotation;

wherein upon activation of said first-foot-pedal-valve and said second-foot-pedal-valve a user is able to cycle said toilet-seat-cover and said toilet seat respectively, between lifted and lowered positions, via said lifting and lowering mechanism;

wherein said toilet seat lifter-toilet foot pedal system is structured and arranged to provide sanitary, hands-free manipulation of said toilet seat and said toilet-seat-cover in relation to said toilet fixture to promote improved public health; and wherein said lid engager further comprises a gear cluster to allow engagement and release of said toilet seat and said toilet-seat-cover for raising and lowering, respectively.

2. The toilet seat lifter-toilet foot pedal system of claim 1 wherein said lifting and lowering mechanism comprises a hydraulic lifter device comprising a cylinder assembly remotely connected via said connector hose to said lid engager as coupled to said toilet seat and said toilet-seat-cover for raising said toilet seat and said toilet-seat-cover repeatedly as desired.

3. The toilet seat lifter-toilet foot pedal system of claim 2 wherein said hydraulic lifter device includes a fluid comprising water.

4. The toilet seat lifter-toilet foot pedal system of claim 2 wherein said hydraulic lifter device includes a fluid comprising a non-compressible liquid.

5. The toilet seat lifter-toilet foot pedal system of claim 1 wherein said raising and said lowering are speed-controlled.

6. The toilet seat lifter-toilet foot pedal system of claim 1 wherein said first-foot-pad is activated to cause a raising condition via a single-press.

7. The toilet seat lifter-toilet foot pedal system of claim 1 wherein said first-foot-pad is activated to cause a lowering condition via a double-press.

8. The toilet seat lifter-toilet foot pedal system of claim 1 wherein said second-foot-pad is activated to cause a raising condition via a single-press.

9. The toilet seat lifter-toilet foot pedal system of claim 1 wherein said second-foot-pad is activated to cause a lowering condition via a double-press.

10. A toilet seat lifter-toilet foot pedal system comprising:

a toilet seat lifter-toilet foot pedal assembly including;

a foot-pedal-assembly having;

a housing;

a first-foot-pad for remotely manipulating a toilet-seat-cover having;

a first-foot-pedal-valve;

a second-foot-pad for remotely manipulating a toilet seat having;

a second-foot-pedal-valve;

a lifting and lowering inducing means;

a connector hose; and a lid engager;

wherein said toilet seat lifter-toilet foot pedal system comprises said toilet seat lifter-toilet foot pedal assembly;

wherein said toilet seat lifter-toilet foot pedal assembly comprises in functional combination said foot-pedal-assembly, said connector hose, and said lid engager;

wherein said foot-pedal-assembly comprises said housing, said first-foot-pad, said second-foot-pad, and said lifting and lowering inducing means suitably in communication for operative use;

wherein said connector hose connects said foot-pedal-assembly and said lid engager, said lid engager coupled to said toilet seat and said toilet-seat-cover on a toilet fixture;

wherein upon activation of said first-foot-pedal-valve and said second-foot-pedal-valve a user is able to cycle said toilet-seat-cover and said toilet seat, respectively, between lifted and lowered positions, via said lifting and lowering inducing means;

wherein said lifting and lowering inducing means comprises a hydraulic lifter device comprising a cylinder assembly having a piston within a cylinder remotely connected via said connector hose to said lid engager as coupled to said toilet seat and said toilet-seat-cover for raising said toilet seat and said toilet-seat-cover as desired;

wherein said foot-pedal-assembly further comprises at least one compound valve for controlling a supply of fluid under pressure to said cylinder, means for connecting a source of hydraulic pressure to said first-foot-pedal-valve and said second-foot-pedal-valve, a compound valve element in said first-foot-pedal-valve and said second-foot-pedal-valve movable in one direction at a time, and means for controlling said supply of hydraulic pressure to and from said cylinder;

wherein said fluid comprises a non-compressible liquid;

wherein said lid engager comprises a mechanical gear cluster suitable to manipulate said toilet seat and said toilet-seat-cover about a common axis of rotation;

wherein said lid engager further comprises clutches to allow engagement and release of said toilet seat and said toilet-seat-cover according to a number of relative foot-presses for raising and lowering, respectively; and wherein said toilet seat lifter-toilet foot pedal system is structured and arranged to provide sanitary, hands-free manipulation of said toilet seat and said toilet-seat-cover in relation to said toilet fixture to promote improved public health.

11. The toilet seat lifter-toilet foot pedal system of claim 10 further comprising a kit including: said foot-pedal-assembly, said connector hose, said lid engager, and a set of user-instructions.

12. A method of using a toilet seat lifter-toilet foot pedal system comprising the steps of:

installing a toilet seat lifter-toilet foot pedal assembly to a toilet fixture;

activating said toilet seat lifter-toilet foot pedal assembly to raise a toilet-seat-cover via a first single foot-push on a first-foot-pad;

activating said toilet seat lifter-toilet foot pedal assembly to raise a toilet seat via a single foot-push on a second-foot-pad;

using said toilet fixture; and activating said toilet seat lifter-toilet foot pedal assembly to lower said toilet seat via a first double foot-push on said second-foot-pad; and activating said toilet seat lifter-toilet foot pedal assembly to lower said toilet-seat-cover via a double foot-push on said first-foot-pad.

* * * * *